US008101026B1

(12) United States Patent
Brooks

(10) Patent No.: US 8,101,026 B1
(45) Date of Patent: Jan. 24, 2012

(54) CPC (COPPER PIPE CLEANER) ATTACHMENT FOR STANDARD POWER DRILLS

(75) Inventor: Maurice Dale Brooks, North East, MD (US)

(73) Assignee: Maurice Dale Brooks, Northeast, MD (US)

( * ) Notice: Subject to any disclaimer, the term of this patent is extended or adjusted under 35 U.S.C. 154(b) by 0 days.

(21) Appl. No.: 13/199,421

(22) Filed: Aug. 30, 2011

Related U.S. Application Data

(60) Provisional application No. 61/402,834, filed on Sep. 7, 2010.

(51) Int. Cl.
*B08B 1/00* (2006.01)

(52) U.S. Cl. ..... 134/6; 134/8; 134/18; 134/22.1; 134/22.11; 134/42; 15/104.04; 15/104.05; 15/104.09; 15/104.095

(58) Field of Classification Search ..... 134/6, 8, 134/18, 22.1, 22.11, 42; 15/104.04, 104.05, 15/104.09, 104.095
See application file for complete search history.

(56) References Cited

U.S. PATENT DOCUMENTS 5,269,104 A * 12/1993 DiBiagio ..... 451/344
6,106,370 A * 8/2000 Carter ..... 451/51
6,698,048 B1 * 3/2004 Greene ..... 7/158
6,813,797 B1 * 11/2004 Kadinger ..... 15/104.04
2004/0255414 A1 * 12/2004 Tulipana ..... 15/104.04
* cited by examiner

*Primary Examiner* — Bibi Carrillo

(57) ABSTRACT

The invention is an elongated device which prepares pipes and fittings for bonding in a matter of seconds. This unit attaches to a drill and embodies brushes which clean both the interiors and exteriors of pipes and fittings varying in size. The vertical brush's unique folding assembly allows quick and easy access to the exterior brush without the removal of any parts.

1 Claim, 2 Drawing Sheets

CPC (COPPER PIPE CLEANER) ATTACHMENT FOR STANDARD POWER DRILLS

This application claims priority from provisional application with Ser. No. 61/402,834 filed on Sep. 7, 2010.

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

This invention is a plumbing tool, which cleans and prepares the interior and exterior of pipes and fittings for bonding. More specifically, it accomplishes the dual task of cleaning a pipe or fitting's interior and exterior without forcing a cessation in labor or requiring the substitution of one or more tools.

In liquid transport systems, the likes of which are found within most buildings, it is necessary to connect piping to fittings. Before the two may be coupled, it is essential to first utilize an abrasive material to clean and lightly texturize the surfaces to ensure a tight and secure bond. This must be done when installing new plumbing and when making repairs to existing plumbing.

In the past, it has been customary to manually employ handheld wire brushes to clean and prepare the interiors of pipes and fittings, as well as emery cloth or specially designed wire brushes to prepare the exteriors. Using these materials, one has to laboriously clean the insides and outsides of both ends of each copper fitting and pipe segment by hand, a task which is proven to be inconvenient and time consuming.

Efforts have been made to produce tools to perform this task. Prior art includes U.S. Pat. Nos. 6,698,048B1; 5,269,104; and 6,106,370. However, these previous inventions are complicated and do not complete the task most efficiently. Two of these require the purchase of an entirely new motorized tool and the third attaches to a drill, but, as with the others, parts must be interchanged to perform its various functions. The previous devices achieve their respective purposes, but this invention incorporates a simpler design to consolidate two tools into one.

BRIEF SUMMARY OF THE INVENTION

The invention is an attachment for standard power drills that incorporates both interior and exterior cleaning brushes into a single unit. The unique pivoting feature of the attachment eliminates the need to stop and exchange parts, and because it attaches to any standard power drill, the need for two separate handheld tools is also eliminated.

An object of the invention is to set forth an attachment for standard power drills which cleans and prepares pipes and fittings for bonding in a matter of seconds.

Another object of the invention is to set forth a tool attachment which includes, in a single unit, brushes for cleaning both the interiors and exteriors of pipes and fittings.

A further object of the invention is to set forth a tool attachment which does the job of at least two separate tools without the removal or exchange of any parts.

A still further object of the invention is to set forth a tool attachment which incorporates a unique pivoting feature that allows the user to switch between brushes quickly and easily.

DETAILED DESCRIPTION OF THE INVENTION

Figure 1:
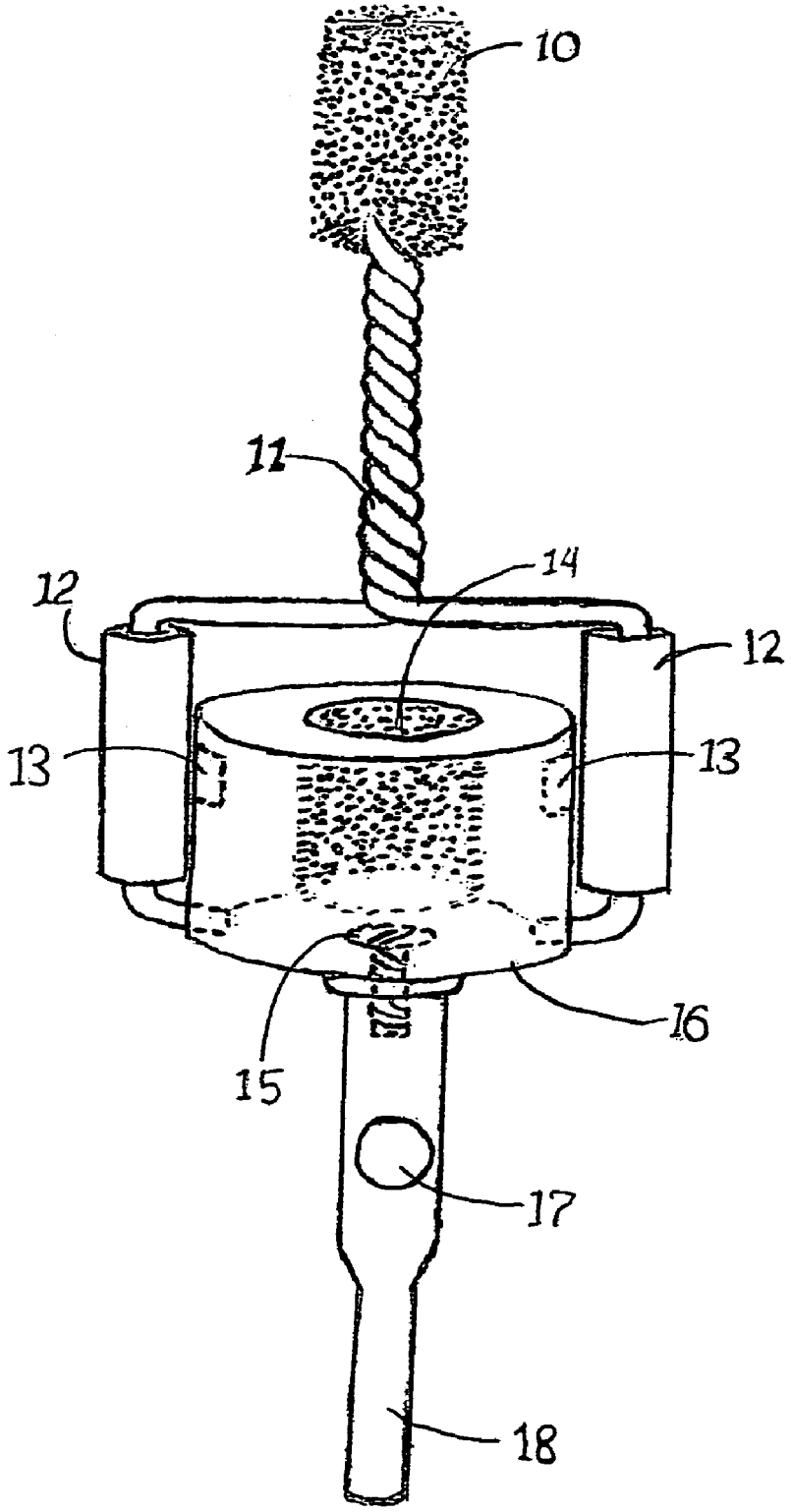
FIG. 1 is a frontal view of the attachment device in position for usage of interior pipe and fitting cleaning.
Figure 2:
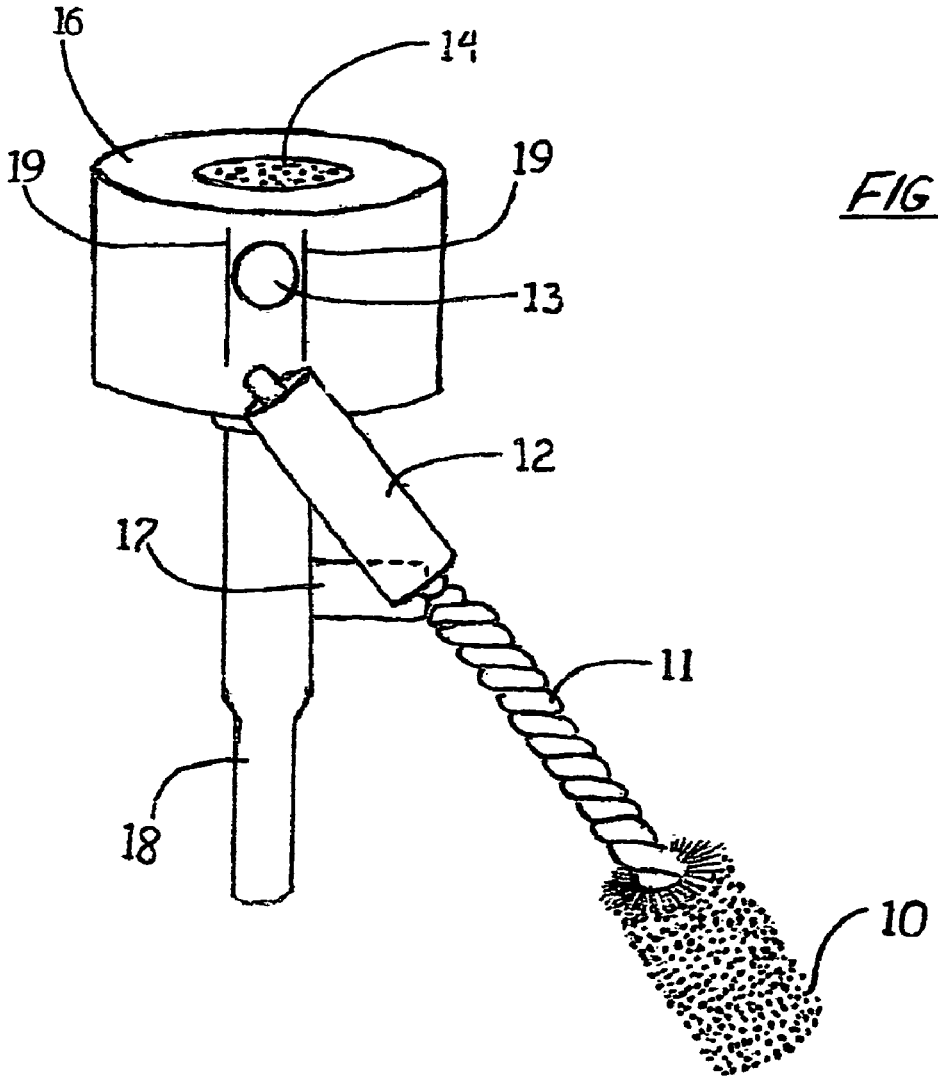
FIG. 2 is a perspective view of the attachment device showing the interior cleaning brush in the alternate position, which allows access to the exterior pipe and fitting cleaner.

A wire brush (10) is connected to a pivoting metal shaft (11), which is held upright by two metal spacers (12) and four steel wire strips (19) (as shown in FIG. 2). Two magnets (13) embedded in the surface of the housing unit (16) attract the spacers (12) to lock the pivoting shaft (11) in the upright position, as shown in FIG. 1. In this position, the wire brush (10) is extended and available for use.

The two magnets (13) are recessed in the exterior brush housing unit (16) which contains an open cylindrical wire brush (14). The housing unit (16) is attached to a shaft (18) by a bolt (15). A projected magnet (17) is bonded to the shaft (18) near the housing unit (16). The pivoting metal shaft (11) swings downward and attaches to the aforementioned magnet (17) to leave the open cylindrical brush (14) exposed and accessible as demonstrated in FIG. 2.

The exposed tip of the metal shaft (18) fits into the chuck of any standard power drill to power the invention in both described embodiments. After inserting the attachment into the chuck, the user either inserts the extended brush (10) into the pipe or fitting, or inserts the pipe or fitting end into the open cylindrical wire brush (14), and powers on the drill. The drill enables the attachment to revolve inside or around the surface of the pipe or fitting, cleaning and preparing it for bonding within seconds.

The previous description is indicative of the preferred embodiment of the invention; still, it is meant to be representative of the invention as opposed to definitive thereof. The invention is defined in the claims.

I claim:

1. A method for cleaning a pipe or fitting with an attachment device, without removal or exchanging of parts, comprising:

providing an attachment device, the attachment device having a housing comprising an open cylindrical wire brush and a swivel mounted appendage attached to an extended wire brush;

cleaning an interior surface of a pipe or fitting by inserting the extended wire brush into the interior surface of the pipe or fitting and powering on a drill to activate the attachment device;

pivoting the swivel mounted appendage in a downwardly direction to access the housing containing the open cylindrical wire brush; and cleaning an exterior surface of the pipe or fitting by inserting the pipe or fitting into the open cylindrical wire brush and powering on the drill to activate the attachment device.

* * * * *